United States Patent [19]

Yun

[11] 4,290,280

[45] Sep. 22, 1981

[54] PADLOCK

[76] Inventor: Sun Y. Yun, 561-12 Yeonnam-dong, Seodaimoon-ku, Seoul, Rep. of Korea

[21] Appl. No.: 23,280

[22] Filed: Mar. 23, 1979

[51] Int. Cl.[3] ..... E05B 67/22

[52] U.S. Cl. ..... 70/38 A; 70/52

[58] Field of Search ..... 70/38 A, 52, 39, 24, 70/25, 26, 38 B, 38 C, 38 R, 31, 35, 51

[56] References Cited

U.S. PATENT DOCUMENTS

| | | | |
|---|---|---|---|
| 2,457,650 | 12/1948 | Dyson | 70/38 A |
| 2,691,288 | 10/1954 | Childs | 70/38 A |
| 3,882,699 | 5/1975 | Flack | 70/38 A |
| 3,952,565 | 4/1976 | Falk | 70/52 |
| 4,112,715 | 9/1978 | Uyeda | 70/38 A |

*Primary Examiner*—Robert L. Wolfe
*Attorney, Agent, or Firm*—Holman & Stern

[57] ABSTRACT

Padlock made of a body cast as a frame block having a cylinder assembly space and shackle holes. The assembly space has securing members extending thereinto. A semi-circular shackle has a center portion and two ends which are slidable through the shackle holes and co-act with locking edges of locking bars. The locking bars together with operatively associated cam form the locking member unit which is housed in the assembly space. A cylinder assembly unit is operatively associated with the cam and comprises the usual pin and spring tumbler unit. A closing member seals the bottom of the padlock. Portions of the frame block can extend up around the shackle covering all but the center portion.

2 Claims, 16 Drawing Figures

PRIOR ART

PADLOCK

BRIEF SUMMARY OF THE INVENTION

This invention relates to an improvement of a padlock; and, more particularly, concerns a padlock in which the frame block is prepared by a single casting and the cylinder assembly unit as well as the locking member unit are simply inserted into the inner space of the cast frame block.

It is common that ordinary padlocks are usually prepared by milling or boring each of the necessary areas out of a solid block. The necessary components comprising the cylinder assembly and the locking member are inserted individually through the bored holes and, by assembling each of the necessary components through the bored holes, a padlock is obtained. In other words, it is the common procedure that, in order to produce a padlock, the holes for the shackle are bored into the upper part of the frame block of the padlock and, in order to prepare the space for inserting the cylinder assembly and the hole for the other components, the bottom of the frame block of the padlock is bored individually. In order to fix the tumbler cylinder assembly and the shackle in their positions in the inner part of the frame block of the padlock and to fix the position of each of the components, the locking member must be also inserted individually through the hole bored in the side of the frame block of the padlock. So, indeed, it is a disadvantage that, in order to produce a padlock, several individual processes and much manual labor are required. The padlock of the prior art is illustrated in FIGS. 1 to 4 and 9.

According to FIG. 1 illustrating how the padlock of the prior art is manufactured, it is notable that the upper part of the frame block (1) of the padlock is bored by tools 2*a* and 3*a* to form the holes (2) and (3) for the shackle and the bottom of the frame block is bored by tools 4*a* and 4*b* for form the space (4) for the tumbler and cylinder assembly by a drilling boring machine, etc. And, in order to insert the locking member which is operatively associated with not only the shackle but also with the tumbler assembly, the side of the frame block (1) is also bored by tool 5*a* to form the hole (5). Actually, the common padlock has not only the partition (6) located between the hole (2) and the space (4) but also the partition (7) located between the hole (3) and the space (4).

According to the prior art, it is common that each of the necessary components illustrated in FIG. 9 be inserted individually into the holes and the space prepared in the inner part of the frame block of the padlock and must be assembled individually at the holes and the space in the frame block.

According to FIG. 9, it is notable that the one end (8*a*) of the shackle (8) is located to be inserted into the hole (2) and the other end (8*b*) of the shackle (8) into the hole (3) bored into the upper part of the frame block (1). Before the installation of the cylinder member (9), a pair of locking balls (10*a*) and (10*b*) and the cam member (10*c*) are inserted to be placed in the hole (5). The cam member (10*c*), connected with the pin tumbler cylinder assembly (9), controls the locking and opening operation of the locking balls (10*a*) and (10*b*). As commonly known, the tumbler cylinder assembly (9) consists of the tumbler pins and coil springs. The cylinder assembly is connected tightly with the frame block (1) by the bolt (11). The hole (5) prepared for insertion of the locking balls (10*a*) and (10*b*) is closed by the seal (12).

However, the padlock in the prior art produced as above has the defects as noted below as well as others:

Firstly, the holes for the shackle and the holes for the cylinder assembly must be selected in accordance with the intended use; and must be processed by a precisely operating boring machine.

Secondly, as explained above, the hole for inserting the locking member must be prepared separately by the boring machine, after the preparation of the holes located in the upper part and the bottom of the frame block of the padlock.

Thirdly, after the installation of the shackle, the locking member and the cylinder assembly into the frame block of the padlock, in order to protect the combination of these assemblies from being destroyed or tampered with, another process for sealing the hole prepared on the side of the frame block must be added.

Fourthly, because the locking balls are placed on each of the partitions prepared between the hole for the one end of the shackle and the hole for the other end of the shackle and the hole for the cylinder assembly and, in order to give the locking balls smooth action, the partitions should form a thin surface in the thickness. Thus, the partitions can be easily defaced by the action of the locking member.

A main object of the present invention is to produce a padlock wherein the necessity for boring the holes for the both ends of the shackle and the hole for the cylinder assembly unit in the frame block is eliminated by providing the inner part of the frame block with a space by a single casting process. The padlock comprises a body cast as a frame block having a cylinder assembly space and shackle holes, said cylinder assembly space having securing members extending thereinto; a semicircular shackle having a center portions and two ends slidable through said shackle holes, a locking member unit housed in said space and having a cam and locking bars operatively associated with said cam, each said bar having a locking edge for co-acting with one of said s shackle ends, a cylinder assembly unit operatively associated with said cam for lockingly operating said locking member unit; a closing member; and screw means for securing said cylinder assembly to one securing member in said cylinder assembly space and for securing said closing member to another securing member in said frame block.

Another object of the present invention is to reduce the unnecessary labor and production expenses by providing a padlock wherein a space is shaped in the inner part of the frame block by a single casting process and the completed locking member unit and the pin tumbler cylinder assembly unit are inserted into the space in the frame block of the padlock.

Another object of the present invention is to produce a padlock that can provide a good locking effect because the complete assembly units are inserted into the space prepared by the casting process.

A further purpose of the present invention is to produce a padlock that, because the locking member unit is also a part of the completed assembly units to be inserted into the inner space of the frame block, as the shackle is inserted into the holes, the both ends of the shackles are correctly associated with the locking member unit of the completed assembly unit, and can provide good locking effect.

According to the present invention, it is possible to not only simplify the manufacture but also mass produce padlocks because the frame block of the padlock is obtainable easily by a single casting processing system. Namely, according to the present invention, the frame block of the padlock is casted by a single casting process and the assembly of the locking member unit and the cylinder assembly unit can be easily made into the inner space of the frame block of the padlock.

DETAILED DESCRIPTION

Figure 1:
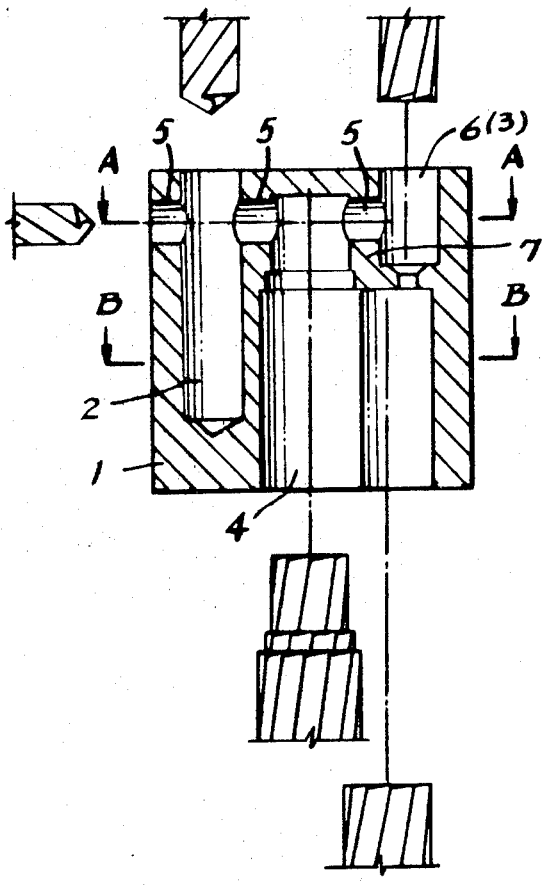
FIG. 1 is the cross-sectional view showing how the frame block of the padlock of the prior ar is produced.
Figure 2:
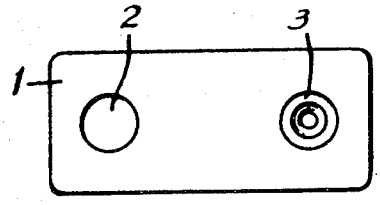
FIG. 2 is the plane view of the frame block of the padlock in FIG. 1.
Figure 3:
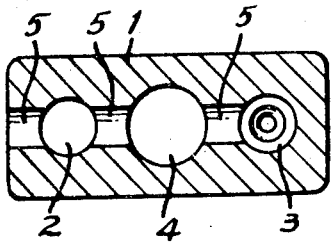
FIG. 3, is the cross-sectional view of the frame block cut along the line A—A of FIG. 1.
Figure 4:
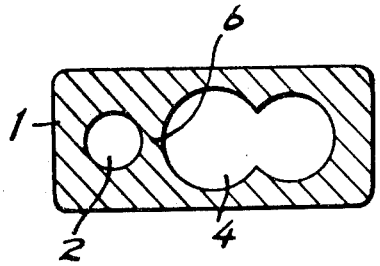
FIG. 4 is the cross-sectional view of the frame block cut along the line B—B of FIG. 1.
Figure 5:
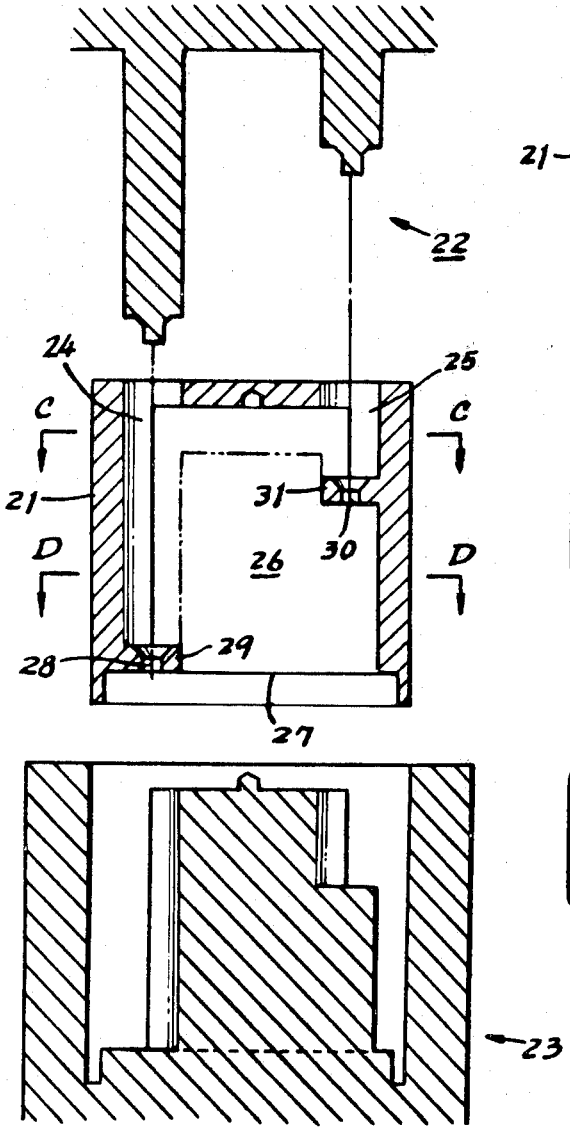
FIG. 5 is the cross-sectional view showing how the frame block of the padlock in the present invention is produced.
Figure 6:
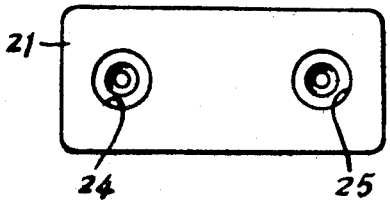
FIG. 6 is the plane view of the frame block of the padlock in FIG. 5.
Figure 7:
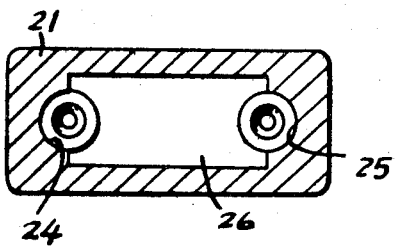
FIG. 7 is the cross-sectional view cut along the line C—C of FIG. 5.
Figure 8:
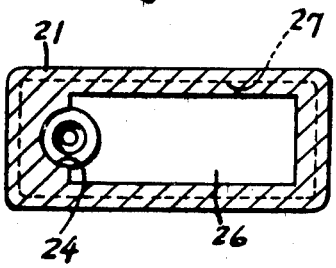
FIG. 8 is the cross-sectional view cut along the line D—D of FIG. 5.
Figure 9:
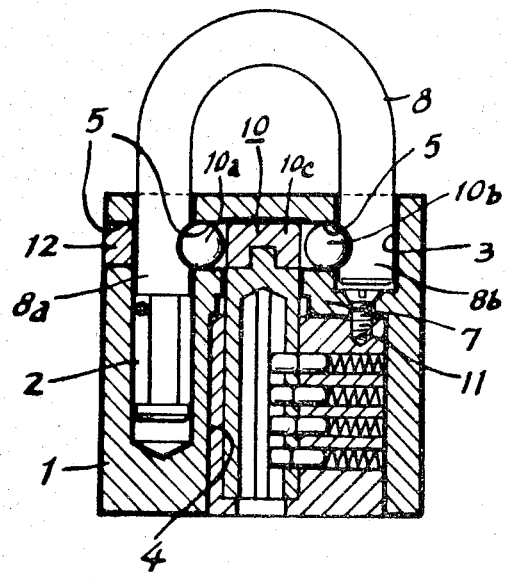
Fig. 9 PRIOR ART
FIG. 9 is the cross-sectional view of the padlock of the prior art.

Further explanation of the present invention is illustrated in detail in accordance with the accompanying drawings, as follows:

From FIG. 5 and FIG. 6 to 8, it is notable how the frame block (21) of the padlock of the present invention can be cast and each of the necessary components can be constructed and also equipped to the inner part of the cast frame block of the padlock. As illustrated in FIG. 5, the frame block (21) of the padlock is obtained by a single casting process. Namely, the upper part of the frame block is cast by the upper mold (22) and the bottom of the frame block is also cast by the bottom mold (23) so that the frame block of the padlock, that is characterized by the present invention, is obtained. By the upper mold (22), the hole (24) and the hole (25) for the shackle are shaped and, by the bottom mold (23), the space (26) for the assembly of the locking member unit and the pin tumbler cylinder assembly unit is prepared. On the bottom of the frame block, a closing member (27) can be provided by which the location of the assembly of the locking member unit and the pin tumbler cylinder assembly unit is supported.

In order to fix the assembly of the locking member unit and the pin tumbler cylinder assembly unit to the frame block (21), the frame block has a supporting member (31) on the bottom of the hole (25). The supporting member (31) has a bolt hole (30) through which the assembly of the locking member unit and the pin tumbler unit is fixed to the frame block of the padlock by screw means. The frame block of the padlock has another supporting member (29) on the bottom of the hole (24) with the bolt hole (28). The closing member (27) is fixed to the frame block of the padlock by screw means through bolt hole (28).

As explained above, the characteristic feature of the present invention is the frame block of the padlock having not only the holes (24) and (25) for the shackle ends but also the supporting member (30) for fixing the locking member unit and the pin tumbler cylinder assembly unit and the supporting member (29) for fixing the closing member (27) which supports the location of the assembly of the locking member unit and the pin tumbler cylinder assembly unit to the frame block of the padlock prepared by a single casting process as illustrated in FIG. 5.

Figure 11:
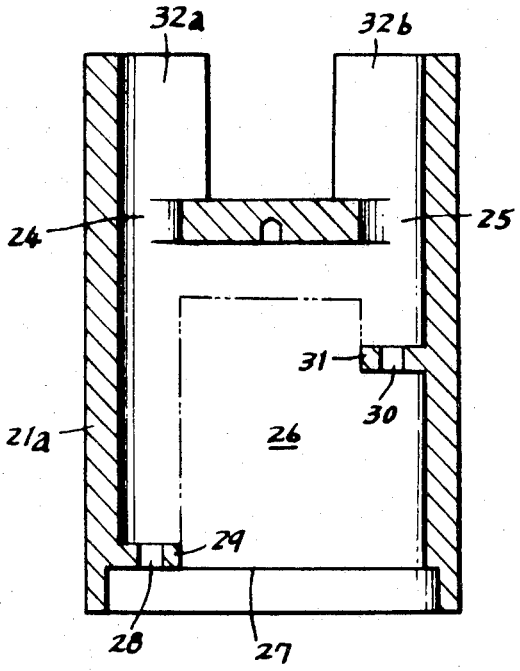
FIG. 11 is the cross-sectional view of another example of the padlock of the present invention illustrated in FIG. 5.

Another embodiment of the padlock is illustrated in FIG. 11. The frame block (21*a*) of the padlock has extended and elongated parts (32*a*) and (32*b*) extending from each of the holes (24) and (25), respectively, to protect the shackle. However, the construction of the locking member unit and the pin tumbler cylinder assembly unit are the same as the one illustrated in FIG. 5.

Figure 10:
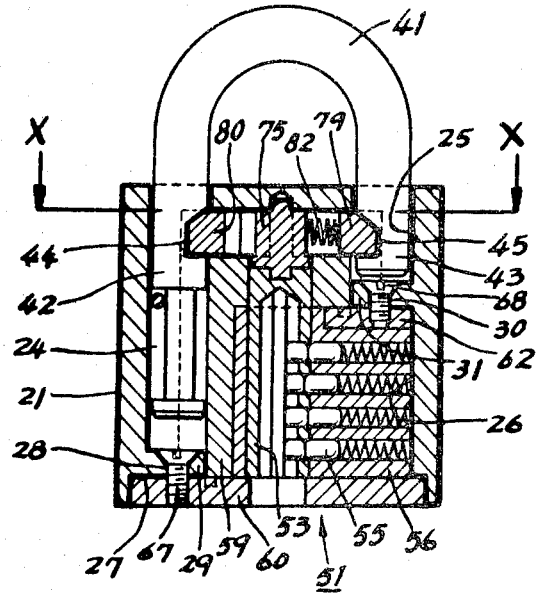
FIG. 10 is the cross-sectional view of the padlock of the present invention.
Figure 12:
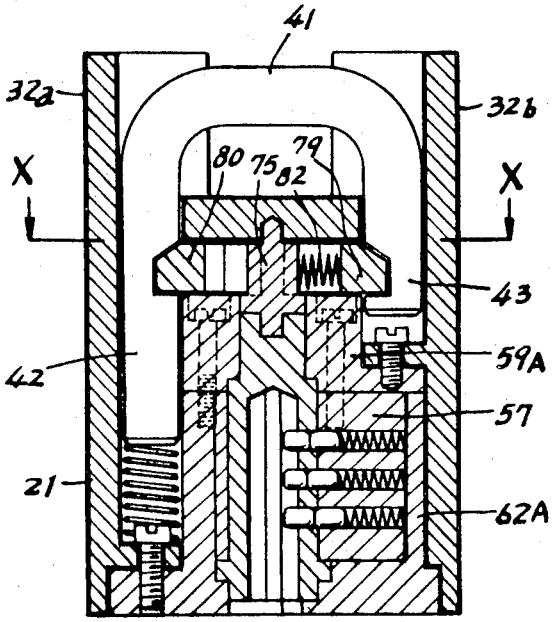
FIG. 12 is the cross-sectional view of the padlock in FIG. 11.

FIGS. 10 and 12 illustrate the construction of the locking member unit and the pin tumbler cylinder assembly unit, that are to be inserted into the space (26) of the frame block of the padlock illustrated in FIGS. 5 and 11. However, it is notable that, except for the fact that the frame block of the padlock illustrated in FIGS. 11 and 12 has the elongated parts (32*a*) and (32*b*), the constructions of each component between the padlock illustrated in FIGS. 10 and 12 are the same as each other.

As illustrated in FIG. 10, it is notable that the shackle (41) is simply the common one not only having a semicircular form but also having both ends (42) and (43) milled with the locking concaves (44) and (45), respectively; and each of the ends is inserted into one of the holes (24) and (25) in the frame block (21) of the padlock.

Figure 15:
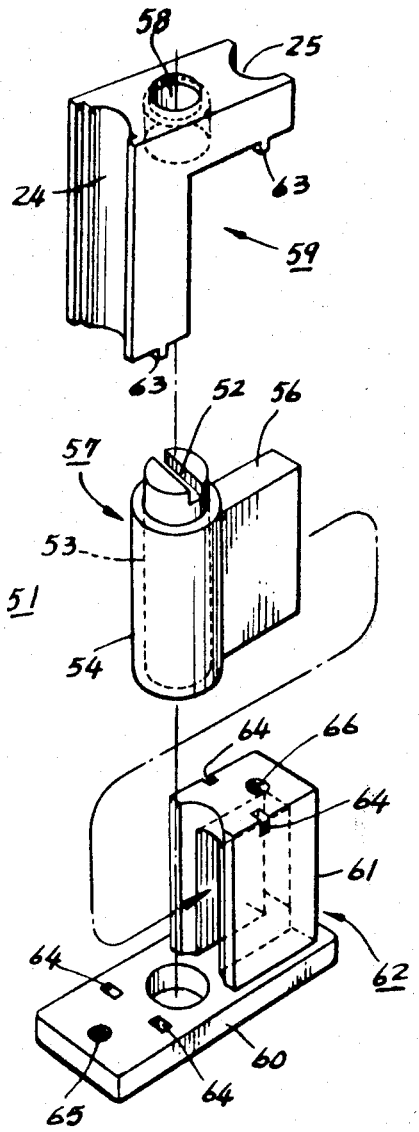
FIG. 15 is the analyzed perspective view of the tumbler-pin type cylinder assembly unit, according to th present invention.

The cylinder assembly unit (51) is illustrated in FIG. 15. The cylinder assembly unit (51) consists of the cylinder (54) in which the turning member (53) having a groove (52) is inserted; the cylinder lock (57) having a projection member (56) in which several tumbler pins (55) are kept; the upper fixing member (59) forming not only the hole (24) for the one end (42) of the shackle but also the hole (25) for the other end (43) of the shackle and also having the hole (58) for the rotation of the turning member (53); and the fixing member (62) with the fixing body (61) which has the space in which the projection member (56) of the cylinder lock (57) is fixed is installed on the bottom supporting member (60) linked to the closing member (27) of the frame block (21) of the padlock.

Because the projecting points (63) of the upper fixing member (59) are fixed into the holes (64) of the bottom supporting member (60) of the bottom fixing member (62) and the top of fixing body (61), it is possible to fix the upper fixing member (59) to the bottom fixing member (62). As the cylinder assembly unit (51) is installed in the frame block (21) of the padlock, because the bolt holes (65) and (66) shaped on the fixing member (62) correspond to the bolt hole (28) of the supporting member (29) and the bolt hole (30) of the supporting member (31), it is possible to fix the cylinder assembly unit (51) to the frame block (21) by the screw means or bolts (67) and (68).

Figure 16:
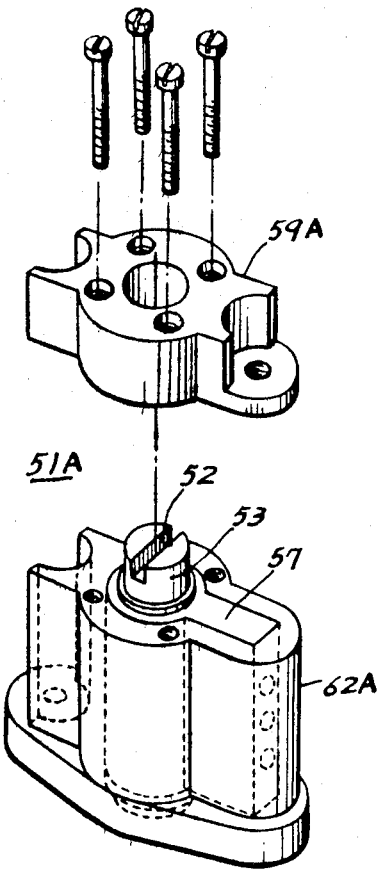
FIG. 16 is the analyzed perspective view of another example of the tumbler-pin type cylinder assembly unit, according to the present invention.

FIG. 16 illustrates another example of the cylinder assembly unit. The cylinder (57) is fixed onto the bottom fixing member (62A) and, in order to control the upward movement of the cylinder lock (57), the upper fixing member (59A) is fixed on the bottom fixing member (62A) by several bolts. The assembling method of the cylinder assembly unit (51A) is the same as the one that is the cylinder assembly unit (51). The installation of the cylinder assembly unit (51A) is illustrated in FIG. 12.

Figure 13:
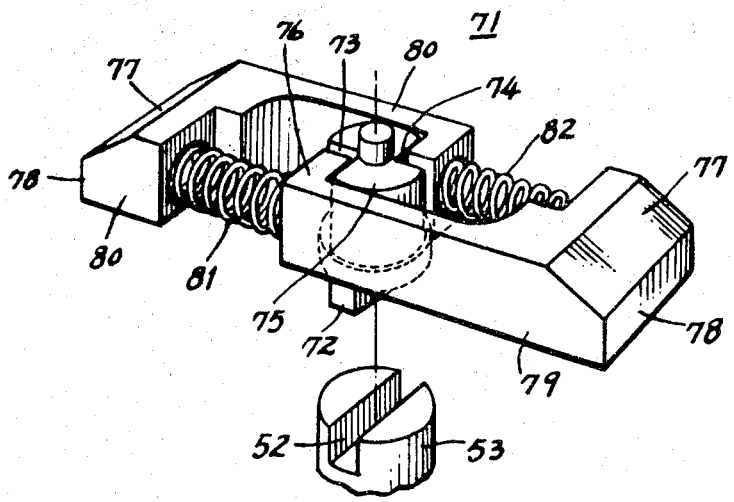
FIG. 13 is the perspective view of the locking member unit of the padlock of the present invention.
Figure 14:
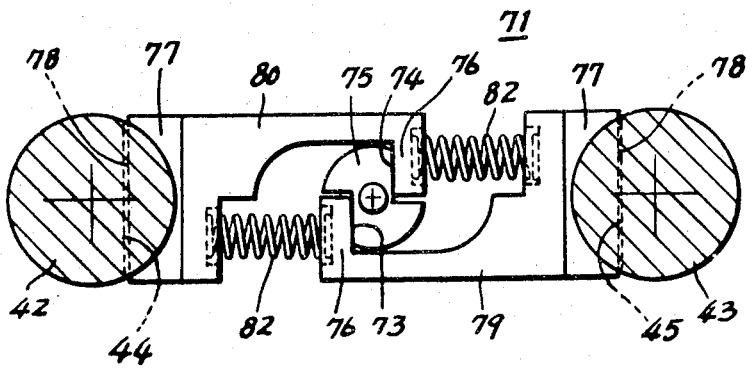
FIG. 14 is the cross-sectional view of the locking member unit of the padlock of the present invention illustrated in FIG. 13.

FIGS. 13 and 14 illustrate the locking member unit (71). Before the installation of the cylinder assembly unit (51) or (51A) to the frame block (21) or (21A) of the padlock, the locking member unit (71) is installed on the upper part of the space (26) and linked with the turning member (53) of the cylinder assembly unit (51). So, by the rotation of the turning member (53), the locking member unit (71) can operate the opening and/or locking of the shackle (41).

The locking member unit (71) consists of the convex portion (72) joining into the groove (52) of the turning member (53); a cam member (75) rotated by the turning of the turning member (53); "L-shape" stopping points (73) and (74); the rear portions (76) of the pair of the locking members (79) and (80). Each member is chamfered having a slope (77) on its end and an edge (78) that is to be locked to or released from the groove (44) and (45) of both ends (42) and (43) of the shackle (41); and coil springs (81) and (82) equipped to push mutually the other side of the locking member (79) and (80) outwardly.

Because each of the locking members (79) and (80) has the slope (77), when the shackle (41) is inserted into the holes (24) and (25), the introduction of both ends of the shackle is smoothly attained and the shackle (41) is tightly locked. Because both locking members (79) and (80) are operated mutually by the cam member (75) and also controlled by the springs (81) and (82), there is no need to prepare the way to lead these locking members.

What is claimed is:

1. Padlock comprising a body case as a frame block having a cylinder assembly space and shackle holes, said cylinder assembly space having securing members extending thereinto;

a semi-circular shackle having a center portion and two ends slidable through said shackle holes;

a locking member unit housed in said space and having a cam and locking bars operatively associated with said cam, each said bar having a locking edge for co-acting with one of said shackle ends, and a rear portion, springs, said locking bars being biased into engagement with said shackle ends by the action of said springs against said rear portions, said cam having L-shaped stopping points into which said rear portions are biased;

a cylinder assembly unit operatively associated with said cam for lockingly operating said locking member unit;

a closing member; and screw means for securing said cylinder assembly to one securing member in said cylinder assembly space and for securing said closing member to another securing member in said frame block.

2. Padlock according to claim 1, wherein each locking bar is chamfered.

* * * * *